US012655842B2

(12) United States Patent
Brevini

(10) Patent No.: US 12,655,842 B2
(45) Date of Patent: Jun. 16, 2026

(54) AXIAL PUMP WITH INCLINED PLATE

(71) Applicant: MIXTRON S.R.L., Reggio Emilia (IT)

(72) Inventor: Stefano Brevini, Reggio Emilia (IT)

(73) Assignee: MIXTRON S.R.L., Reggio Emilia (IT)

( * ) Notice: Subject to any disclaimer, the term of this patent is extended or adjusted under 35 U.S.C. 154(b) by 37 days.

(21) Appl. No.: 18/264,622

(22) PCT Filed: Jan. 18, 2022

(86) PCT No.: PCT/IB2022/050379
§ 371 (c)(1),
(2) Date: Aug. 8, 2023

(87) PCT Pub. No.: WO2022/172099
PCT Pub. Date: Aug. 18, 2022

(65) Prior Publication Data

US 2024/0102467 A1 Mar. 28, 2024

(30) Foreign Application Priority Data

Feb. 11, 2021 (IT) ..... 102021000003044

(51) Int. Cl.
*F04B 1/14* (2020.01)
*F04B 1/145* (2020.01)
(Continued)

(52) U.S. Cl.
CPC ..... *F04B 53/16* (2013.01); *F04B 1/14* (2013.01); *F04B 1/145* (2013.01); *F04B 1/182* (2013.01)

(58) Field of Classification Search
CPC ..... F04B 1/14–188; F04B 53/16
See application file for complete search history.

(56) References Cited

U.S. PATENT DOCUMENTS 2,365,309 A * 12/1944 Talbot ..... F04B 23/14 417/511
3,873,240 A 3/1975 Leduc et al.
(Continued)

FOREIGN PATENT DOCUMENTS

CN 204003304 U * 12/2014
CN 108361165 A * 8/2018 ..... F04B 1/126
(Continued)

*Primary Examiner* — Thomas Fink
(74) *Attorney, Agent, or Firm* — FisherBroyles, LLP; Roger L. Browdy; Ronni S. Jillions

(57) ABSTRACT

The present invention relates to an axial piston pump (1) of the rotating inclined plate type for pumping a liquid comprising: a head (25), a plurality of cylinders (30) made in the head (25) in a number greater than two, having axes (C) parallel to each other and the cylinders being arranged radially around a common axis (A) parallel to the axes of the cylinders, a plurality of pistons (75), each slidingly inserted within a respective cylinder (30) of the plurality of cylinders (30) for the pumping of the liquid, and a plurality of delivery ducts (145) made in the head (25), each of which runs directly from a respective cylinder (30) to a respective delivery valve (120) and is arranged transversely to the axis (C) of the respective cylinder. Where the head (25) has a first side (61) and a second side (62), the second side (62) being opposite to the first side (61) in relation to an imaginary secant plane (S) which contains the common axis (A) and which is parallel to the axes (C) of the cylinders (30), where the plurality of cylinders (30) comprises a first arrangement of cylinders, which has its own axis (C) between the first side (61) and the imaginary secant plane (S), and a second arrangement of cylinders, which has its own axis (C) between the second side (62) and the imaginary secant plane (S). Said delivery ducts (145) running from the cylinders (30) of the first arrangement of cylinders, run from the respective cylinder (30) towards the first side (61), and the
(Continued)

delivery ducts running from the cylinders of the second arrangement of cylinders, run from the respective cylinder (30) towards the second side (62).

7 Claims, 6 Drawing Sheets

(51) Int. Cl.
*F04B 1/182* (2020.01)
*F04B 53/16* (2006.01)

(56) References Cited

U.S. PATENT DOCUMENTS

| | | | | | |
|---|---|---|---|---|---|
| 4,583,921 | A * | 4/1986 | Wolff | F04B 1/124 | 417/539 |
| RE32,373 | E * | 3/1987 | Bobier | F04B 1/20 | 91/506 |
| 2002/0006340 | A1 * | 1/2002 | Nathan | F04B 1/145 | 417/269 |

FOREIGN PATENT DOCUMENTS

| | | | | |
|---|---|---|---|---|
| CN | 108757363 | A * | 11/2018 | F04B 1/122 |
| CN | 108757363 | B | 10/2019 | |
| CN | 111980878 | A * | 11/2020 | |
| SU | 661135 | A1 | 5/1979 | |

* cited by examiner

AXIAL PUMP WITH INCLINED PLATE

TECHNICAL FIELD

The present invention relates to an axial piston pump, in particular an axial piston pump with inclined plate for high pressures and usable with low viscosity fluids.

PRIOR ART

Axial piston pumps with inclined plate generally comprise a head in which at least partially a plurality of cylinders arranged in parallel to each other is made and in each of which a piston slides for the pumping of a liquid. Said cylinders are connected to a liquid source to be pumped through a suction channelling, usually comprising a primary duct and a plurality of branch ducts that place the primary duct in fluid communication with the cylinders.

Axial pumps with inclined plate for high pressures with two pistons are known, which on the one hand are relatively simple to design and manufacture, in particular as regards the construction and design of the suction and delivery channellings, on the other hand, however they show flow rate fluctuations that are not negligible during operation.

An object of the present invention is to make available an axial piston pump with reduced flow rate oscillations at the delivery and which at the same time has a compact and efficient construction from the fluid-dynamic point of view, all within the scope of a rational and cost-effective solution. Such object is achieved by the features of the invention indicated in the independent claim. The dependent claims outline preferred and/or particularly advantageous aspects of the invention.

DISCLOSURE OF THE INVENTION

In particular, the invention makes available an axial piston pump of the rotating inclined plate type for the pumping of a liquid comprising:

- a head,
- a plurality of cylinders made in the head in a number greater than two, having axes parallel to each other and the cylinders being arranged radially around a common axis parallel to the axes of the cylinders,
- a plurality of pistons, each slidingly inserted within a respective cylinder of the plurality of cylinders for the pumping of the liquid,
- a plurality of delivery ducts made in the head, each of which runs directly from a respective cylinder to a respective delivery valve and is arranged transversely to the central axis of the respective cylinder, wherein the head has a first side and a second side, the second side being opposite to the first side in relation to an imaginary secant plane S which contains the common axis and which is parallel to the central axes of the cylinders, wherein the plurality of cylinders comprises a first arrangement of cylinders, which has its own central axis between the first side and the imaginary secant plane, and a second arrangement of cylinders, which has its own central axis between the second side and the secant imaginary plane, and and wherein the delivery ducts running from the cylinders of the first arrangement of cylinders, run from the respective cylinder towards the first side, and the delivery ducts running from the cylinders of the second arrangement of cylinders, run from the respective cylinder towards the second side.

Thanks to this solution, an axial piston pump with reduced flow rate fluctuations at the delivery is made available, as it is provided with more than two cylinders, compact, robust and particularly efficient from the fluid-dynamic point of view. In particular, these characteristics allow in a pump that has more than two cylinders, to minimize the length of the delivery ducts, thus reducing the volume and the surface of the pumping chamber of the pump, which, as is known, comprises a portion of the cylinder, the delivery ducts and suction ducts, and is stressed by the cyclic loads that generate pressure pulsations due to the pumping of the liquid. The minimization of volumes and surfaces subject to such pulsations makes it possible to reduce the dimensions of the pump and/or, with the same pump dimensions, allows the use of less valuable materials, i.e. less resistant to pulsations. This advantage is particularly evident, for example, compared to pumps of the prior art whose delivery ducts open up from a single side of the pump, and therefore it follows that the delivery ducts of the cylinders that are the farthest away from this single side are particularly long and heavily stressed by pressure pulsations.

Obviously, should cylinders have their own central axis on this imaginary secant plane, the direction towards the first side or towards the second side in which the respective delivery duct runs would be indifferent.

According to an aspect of the invention, the pump can comprise a collection channelling configured to collect the liquid exiting from the delivery valves, which is made in the head and comprises a section which follows an annular path in fluid communication with all the delivery valves.

In this way the pump is particularly compact.

According to another aspect of the invention, the pump can comprise a suction valve for each cylinder, in which each suction valve is housed in a seat provided with an outlet mouth in direct fluid communication with an internal volume of the cylinder.

In this way it is possible to further reduce the volume of the pumping chamber, for example since the proposed solution substantially allows the elimination of the suction ducts between the cylinder and the suction valve.

According to yet another aspect of the invention, the pump can comprise a suction channelling for the liquid to be pumped, which is provided with a primary duct and with a plurality of branch ducts, each of said branch ducts being adapted to place the primary duct in fluid communication with a respective cylinder of the plurality of cylinders, and wherein the primary duct is positioned between the central axes of the cylinders.

Thanks to this solution an axial piston pump with reduced flow rate fluctuations at the delivery is made available which is robust and compact and particularly efficient in fluid-dynamic terms.

According to an aspect of the invention, the inlet channelling may be made in the head. In this way the axial compactness of the pump is improved and the assembly operations are made faster.

Preferably the inlet channelling may be made wholly in the head.

According to another aspect of the invention, the primary duct may be equidistant from all the cylinders.

In this way the uniform distribution of the liquid is guaranteed.

According to yet another aspect of the invention, the branch ducts may each comprise a pair of walls, opposing each other, each one provided with respective curved surfaces each one having respectively a single transversal axis of curvature in relation to a plane perpendicular to the central axes of the cylinders.

Thanks to this solution, the branch ducts are simpler and cheaper to make compared to the prior art.

For example, the curved surfaces each comprise a concave portion turned towards the concave portion of the other curved surface.

BRIEF DESCRIPTION OF THE DRAWINGS

Further characteristics and advantages of the invention will become clear from reading the following description provided by way of non-limiting example, with the aid of the figures illustrated in the accompanying tables.

BEST MODE OF THE INVENTION

With particular reference to these figures, 1 indicates overall an axial piston pump for high pressures, preferably suited for pumping liquids with low viscosity, for example water. For example, the axial piston pump 1 is of the type fitted with a fixed inclination rotating plate, as better described below. Furthermore it is of the type fitted with automatic valves and delivery valves for regulating the pumping flow.

Figure 6:
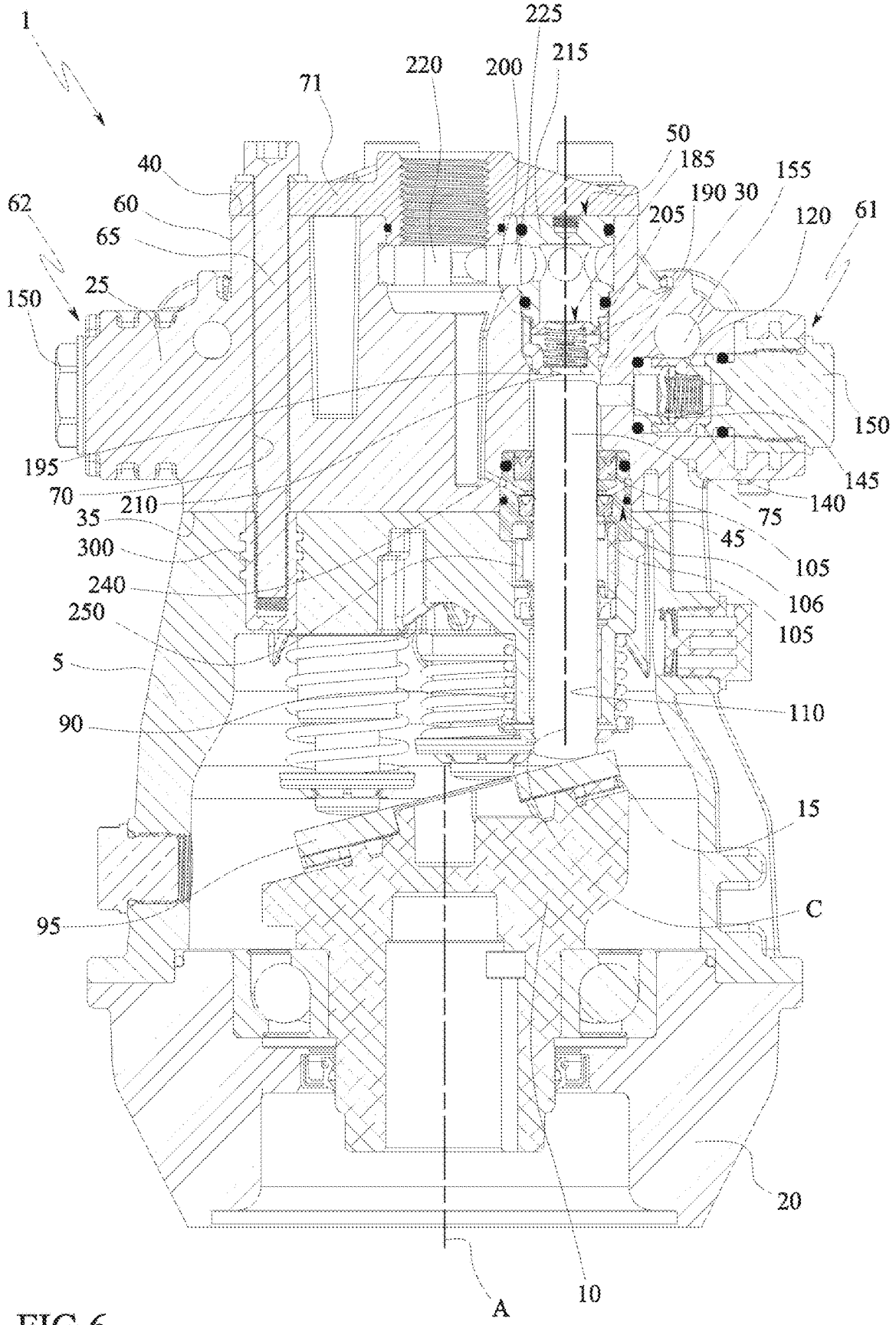
FIG. 6 is a section view of the axial piston pump in FIG. 5 according to the plane VIVI.

As is visible in the section of FIG. 6, the axial piston pump 1 can comprise a base 5, a rotating inclined plate 10, adapted to receive a rotary motion from a drive shaft external to the axial piston pump 1.

The inclined plate 10 is housed in the base 5, is rotatably associated to the base in relation to a pivot axis A, and for example it comprises a flat annular surface 15 lying on an inclined plane in relation to the pivot axis A. In particular, the inclined plate is rotatably associated by a bearing to the flange 20 rigidly fixed, for example bolted, to the base 5.

By means of said flange it is possible to fix the base to a motor or to a frame in relation to which the external drive shaft is rotatably associated.

The axial piston pump 1 comprises a head 25 fixed to the base 5, i.e. fixed without residual degrees of freedom to the base 5, in which a plurality of cylinders 30, i.e. of circular rectilinear holes, is made, each of which has a respective central axis C.

The head 25 can be made as a monolithic body, that is, can be obtained by machining a single body obtained by solidifying a single cast or injection of material into a mould. In the embodiment shown, at least a portion of the head in which the cylinders are made is made of a polymeric material.

The cylinders 30 of the plurality of cylinders 30 are greater than two in number, that is at least three in number, in the embodiment shown they are greater than three in number, for example five, which is an optimal compromise between flow rate regularity and complexity of the pump.

All cylinders are arranged with respective central axes parallel to each other.

For example, the cylinders are arranged radially along a common axis, in relation to which the axes of the single central cylinders are parallel. Furthermore they are placed at an equal distance from each other and at the same distance in relation to the common axis. In other words, the cylinders, that is the central axes of the cylinders, are arranged angularly at an equal distance to each other along an imaginary circumference centred on the common axis and lying on a plane perpendicular to the common axis.

In the embodiment shown, the common axis of the cylinders 30 is coaxial, i.e. it coincides with the pivot axis A.

The cylinders are fixed in space in relation to the base.

Again in the embodiment shown, in which there are five cylinders, the central axes of the cylinders pass through the vertices of an imaginary regular pentagon lying on a perpendicular plane to the central axes of the cylinders.

The cylinders 30 all have the same diameter.

Preferably the cylinders 30 are through cylinders, that is they cross the head 25 from one side to the other. In particular, the head can comprise a first face 35 in contact with the base 5, for example flat, and an opposite second face 40 distal from the base 5 (see in particular FIG. 6).

The cylinders 30, that is the cylindrical holes which form the cylinders, can extend from the first face to the second face. Specifically, each cylinder 30 extends from the first face 35 to the second face 40 creating a first opening 45 in the first face 35 and a second opening 50 in the second face 40. However, it is not excluded that in an embodiment not shown, the holes which form the cylinders may be shaped as blind holes which cross only the first face creating the first opening 45.

The head 25 comprises a side surface 60 (of overall annular/tuboid shape) which extends from the first face to the second face and connects them.

The first face 35 and the second face 40 may be parallel to each other, for example also transversal, preferably perpendicular, to the central axes of the cylinders 30.

A first side 61 and a (diametrically) opposite second side 62, for example being parts of the side surface 60, can be identified in the head. In other words, the side surface comprises the first side and the second side. In practice, the first side and the second side are opposite portions of the side surface.

However, it is not excluded that in an embodiment not shown, the first side and the second side may also be part of the second face 40. That is, the side surface can comprise, or the side surface and the second face can comprise, the first side and the opposite second side. In practice, the first side and the second side can be opposite portions of a surface formed by the side surface and the first face.

The second side 62 is opposite to the first side 61 in relation to an imaginary secant plane S which contains the common axis C, that is the pivot axis A, and which is parallel to the central axes of the cylinders.

The first side 61 and the second side 62 are substantially equidistant from the imaginary secant plane S.

In the head, that is in the side surface thereof (or possibly also in the second face in the same way as described above), a third side 63 and a fourth side 64 can also be identified, which are opposite to each other, connect the first side to the second side from opposite ends of the latter and intersect the imaginary secant plane S.

Overall, in the embodiment shown, the first side, second side, third side and fourth side make up the side surface 60.

In an embodiment not shown, these sides can overall form the side surface and a (peripheral) portion of the second face of the head.

The plurality of cylinders comprises a first arrangement of cylinders, in which each one is arranged with its own central axis between the first side 61 and the imaginary secant plane S, and a second arrangement of cylinders, in which each cylinder is arranged with its own central axis between the second side 62 and the imaginary secant plane S.

In the embodiment, the plurality of cylinders is subdivided entirely between the first arrangement of cylinders and the second arrangement of cylinders.

In particular, the first arrangement of cylinders comprises three cylinders and the second arrangement of cylinders comprises two cylinders.

However, it is not excluded that in an alternative embodiment not shown, the plurality of cylinders may be constituted by the first arrangement of cylinders, by the second arrangement of cylinders and by a third arrangement of cylinders, where in the third arrangement of cylinders each cylinder is arranged with its central axis on the imaginary secant plane. Furthermore, it is not excluded that in an alternative embodiment not shown, in which there are three cylinders, the first arrangement of cylinders may comprise two cylinders and the second arrangement of cylinders may comprise one cylinder.

In practice, each arrangement of cylinders, between the first and the second, must contain at least one cylinder.

The axial piston pump 1 may comprise a plurality of clamping screws 65, for example in a number at least equal to the number of cylinders 30, configured to fix the head 25 to the base 5 and which are inserted in as many through holes 70 made in the head 25. For example, the through holes 70 are arranged angularly at an equal distance from each other along the imaginary circumference centred on the common axis of the cylinders 30. In the embodiment shown, in which both the head and the base are made of polymeric materials, the pump comprises a cover 71, for example made of metallic material, which contacts the second face of the head and in the base there are inserts 300 with a female thread that allows clamping screws 65 to be screwed in order to tighten the head between the cover and the base and thus rigidly connect base, head and cover between them. However, it is not excluded that the cover may also be present in the case of a pump made entirely of metal.

The axial piston pump 1 comprises a plurality of pistons 75 each adapted to slide in a respective cylinder 30, driven by the inclined plate 10 to pump the fluid.

In particular, following the rotation of the inclined plate 10, the pistons 75 are made to slide along the central axes of the respective cylinders 30 between a top dead centre position and a bottom dead centre position.

In the embodiment shown, each piston 75 has a first axial end which is inside the respective cylinder 30 and an opposite second axial end which protrudes from the cylinder inside the base 5 and, via a respective elastic element 90 (see FIG. 6), is held in contact with an annular guide 95 which rests on the flat annular surface 15 of the inclined plate 10, for example by interposition of an axial roller bearing.

Each elastic element 90 has a first end connected to the base 5 and a second end connected to the piston 75, for example near the second end.

The axial piston pump 1 comprises a plurality of annular gaskets 105 adapted to sealingly embrace a respective piston 75, to prevent a fluid communication between the respective cylinder and the base 5. For example, these annular gaskets being some housed in an annular body 106 housed partly in a first housing seat made in the head and partly in a second housing seat made in the base.

This annular body also has another pair of seats, each for a respective o-ring which is interposed between the first housing seat of the annular body and the annular body. Furthermore, the axial piston pump 1 can comprise a plurality of annular guide surfaces 110 made in the base, each adapted to guide a respective piston 75 sliding in the cylinder along a respective sliding axis.

Figure 4:
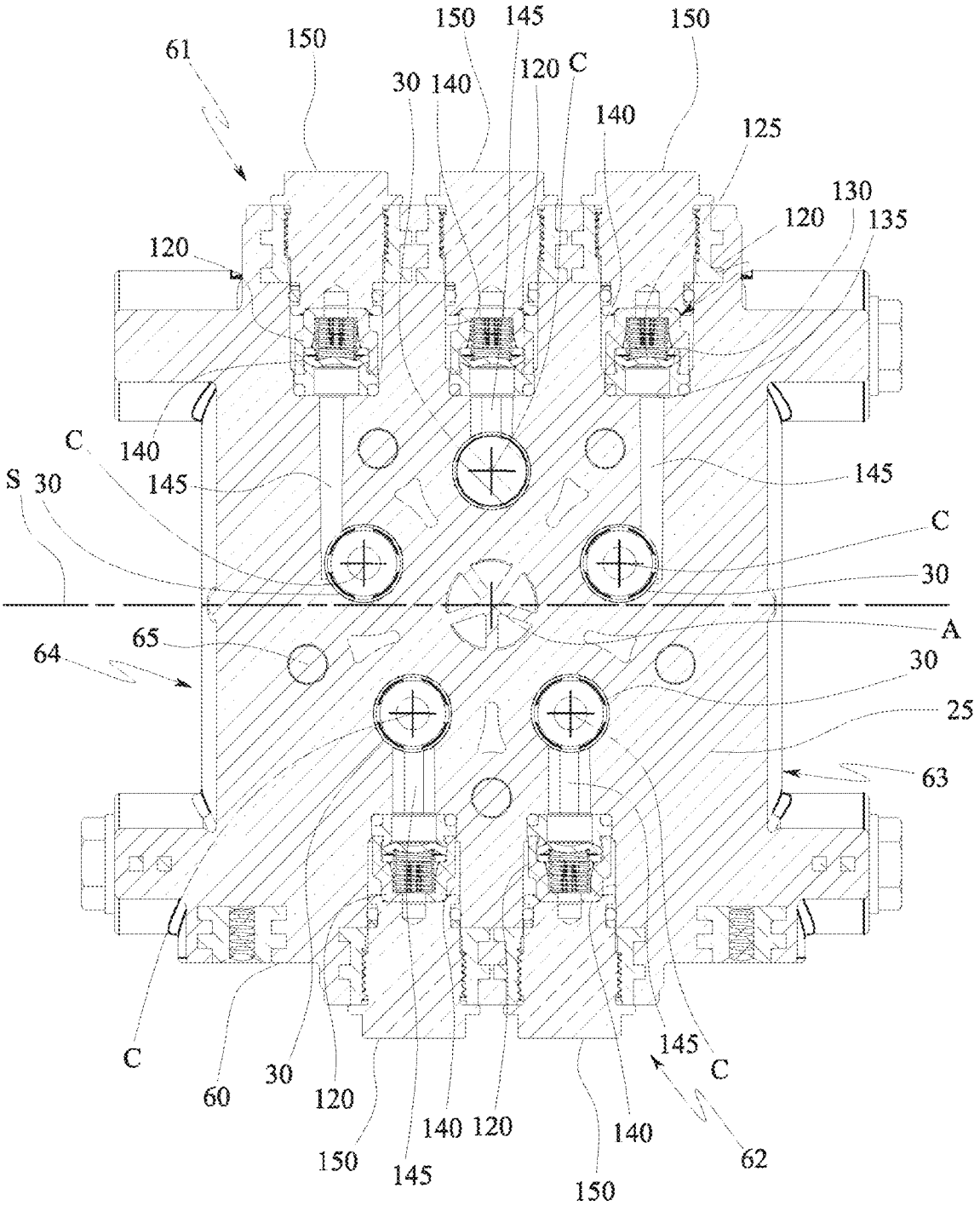
FIG. 4 is a section view according to the plane IV-IV of FIG. 2.
Figure 5:
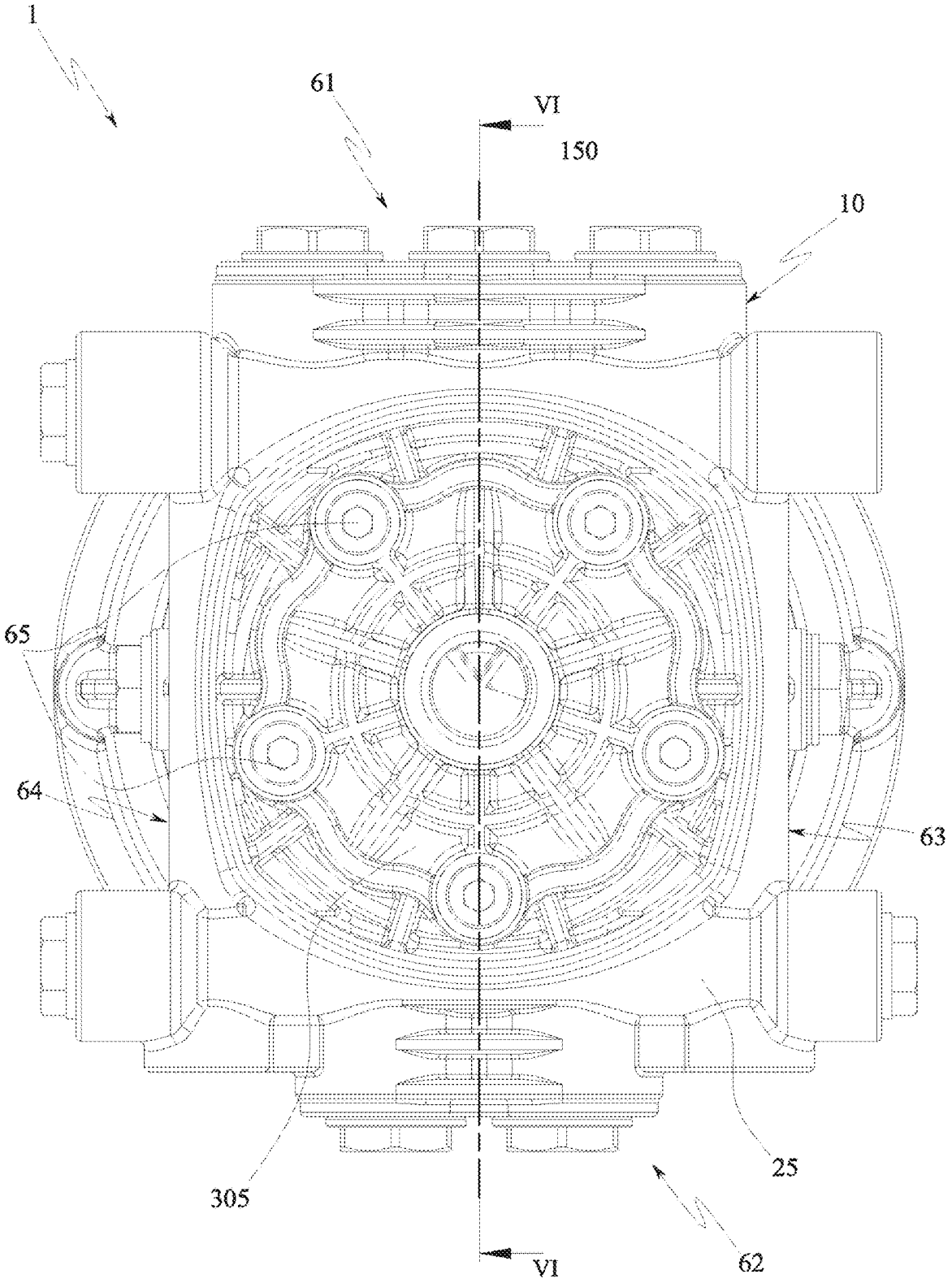
FIG. 5 is a top view of the axial piston pump of FIG. 1.

Furthermore, the pump 1 comprises a delivery valve 120, for example of the automatic type, for each cylinder 30 (see FIGS. 4 and 6).

It is specified that automatic valve refers to a valve configured to open automatically allowing fluid communication, between two environments between which it is interposed, when a pre-set difference between the pressures in both environments divided by the valve is reached. Specifically, automatic valves do not exploit electromechanical operating mechanisms but only differences in pressure.

Each delivery valve comprises a shutter 125 which is held in contact, via an elastic element, with an abutment surface 130 which surrounds a through hole 135, so as to hermetically close said through hole. This through hole is crossed by the fluid pumped by the piston when the shutter is in a distal position from the abutment surface.

When the pressure inside the cylinder rises above a predetermined value, this pressure of the liquid overcomes the force of the elastic element, moving the shutter and allowing it to cross the through hole.

The delivery valves 120 are each housed in a respective housing seat 140 obtained in the head 25.

The seats 140 of the delivery valves are shaped like recesses made in the head and provided with an opening turned towards the outside of the head, through which the valve can be inserted and extracted.

These openings of the seats of the delivery valves, therefore substantially the recesses, are made (only) on the first side or on the second side.

The fact that the seat 140 is made in the first side 61 or in the second side 62 is defined on the basis of whether the respective cylinder 30 enslaved by the delivery valve present in the seat is either part of the first arrangement of cylinders or of the second arrangement of cylinders.

The seats 140 of the delivery valves 120 which serve the first arrangement of cylinders are made at the first side 61, i.e. at the portion of side surface (and/or of second face) of the first side, and the seats 140 of the delivery valves 120 which serve the second arrangement of cylinders are made at the second side 62, i.e. at the portion of side surface (and/or of second face) of the second side.

The pump 1 comprises a plurality of delivery ducts 145 made in the head, each of which runs directly from a respective cylinder 30 to a respective delivery valve 120, i.e. to the housing seat 140 of the respective delivery valve 120.

Each delivery duct has (only) a first opening made in the respective cylinder 30 and an opposite second opening made in the seat of the respective delivery valve.

Each delivery duct 145 is arranged, i.e. has a longitudinal axis arranged transversely, for example perpendicularly to the central axis of the respective cylinder.

Furthermore, each delivery duct 145, i.e. the respective longitudinal axis, is also perpendicular to the imaginary secant plane.

Longitudinal axis refers to an axis that runs in the direction of greatest extension of the duct, or alternatively, for example in the case of a squat duct, it runs along the direction of the flow inside the duct, that is it crosses both the first opening and the second opening. In the embodiment shown, each delivery duct is for example cylindrical in shape and the central axis of a cylindrical internal surface of the duct coincides with the longitudinal axis of the duct.

Regardless of the exact conformation of the delivery duct, the delivery ducts 145 running from the cylinders of the first arrangement of cylinders, run from the respective cylinder towards the first side, and the delivery ducts running from the cylinders of the second arrangement of cylinders, run from the respective cylinder towards the second side.

If the third arrangement of cylinders is present, it is equivalent if the respective delivery ducts run towards the first side or towards the second side.

The pump has for each cylinder 30 a respective pumping chamber, the volume of which is defined, at least in part, by a space between the cylinder and the piston and by the volume of the delivery duct. Therefore, the direction in which the ducts run allows containing the volume of the pumping chamber by reducing the extension thereof as much as possible.

The first opening of each delivery duct 145 is preferably made, for the first arrangement of cylinders, in a portion of the respective cylinder proximal to the first side, and for the second arrangement of cylinders, in a portion of the respective cylinder proximal to the second side.

If the third arrangement of cylinders is present, the first opening is preferably made in the portion of the cylinder closest to the side where it has been decided to create the respective seat of the delivery valve.

In the embodiment shown, each delivery duct 145 is at least partially defined, for example it is entirely defined, by a hole which crosses the recess of the respective housing seat 140 and intersects the respective cylinder 30.

These delivery ducts preferably lie on a single plane, for example perpendicular to the central axes of the cylinders.

The pump 1 can comprise a plurality of delivery plugs 150, one for each opening of the recess of the housing seat, which are configured to hermetically close the openings of said seats which place the seat in communication with the environment external to the pump and to hold the respective delivery valve locked in its respective seat.

Such plugs are for example screwed in the cylinder head.

Therefore, in the embodiment shown, in which the head is made of polymeric material, the pump comprises metal inserts provided with thread to allow screwing the corresponding plug.

Figure 1:
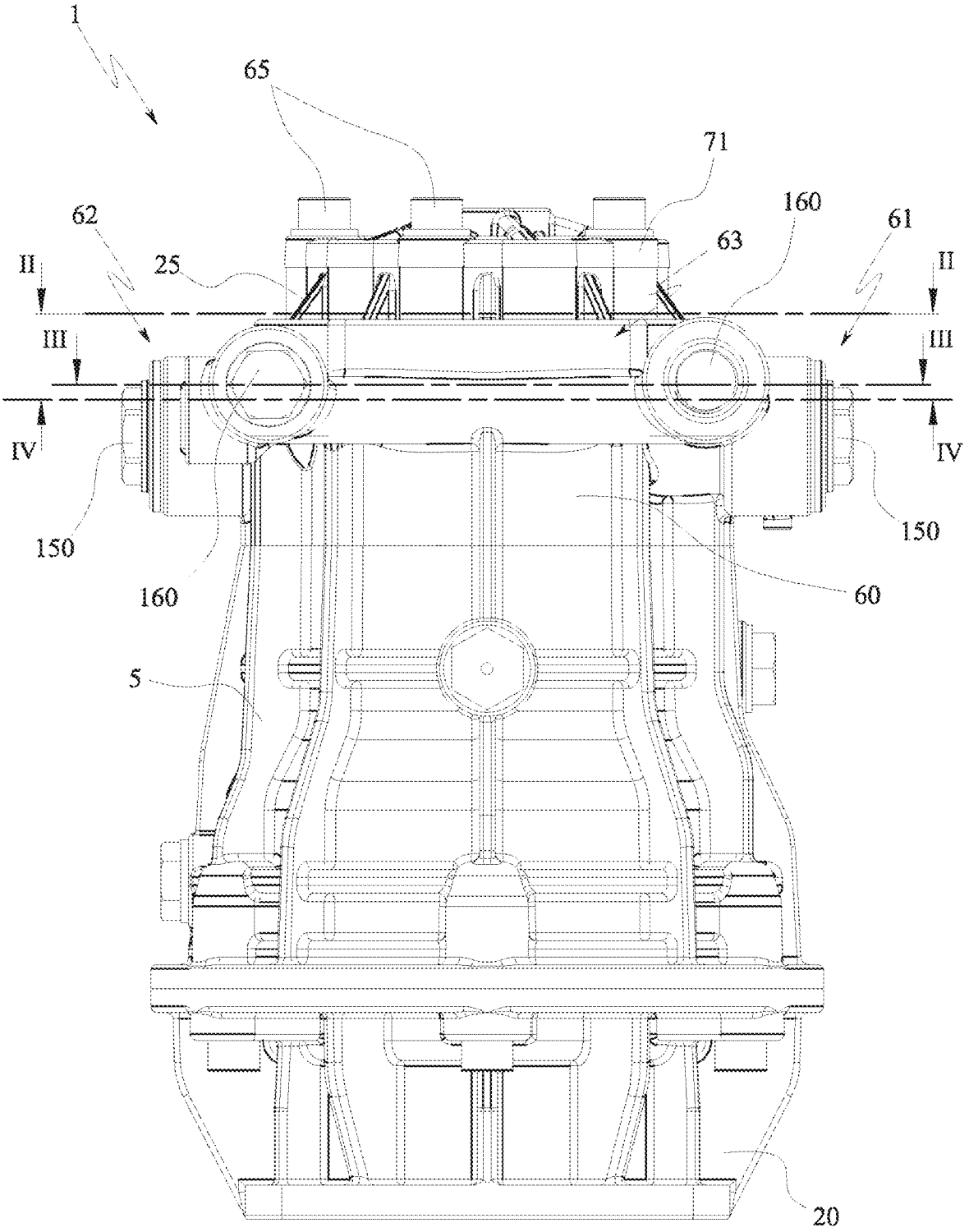
FIG. 1 is a front view of an axial piston pump according to the invention.
Figure 2:
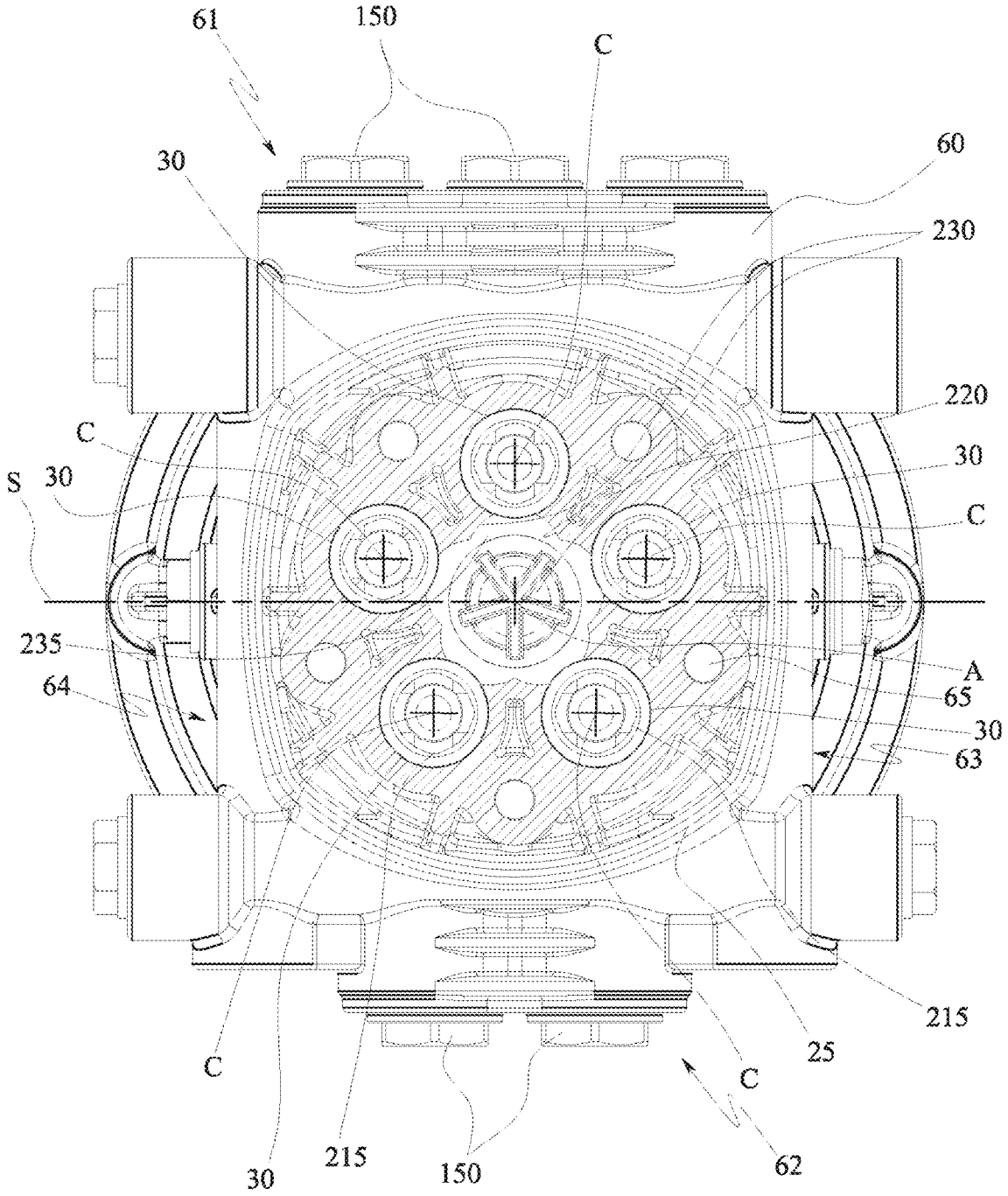
FIG. 2 is a section view of the axial piston pump in FIG. 1 according to the plane II-II.
Figure 3:
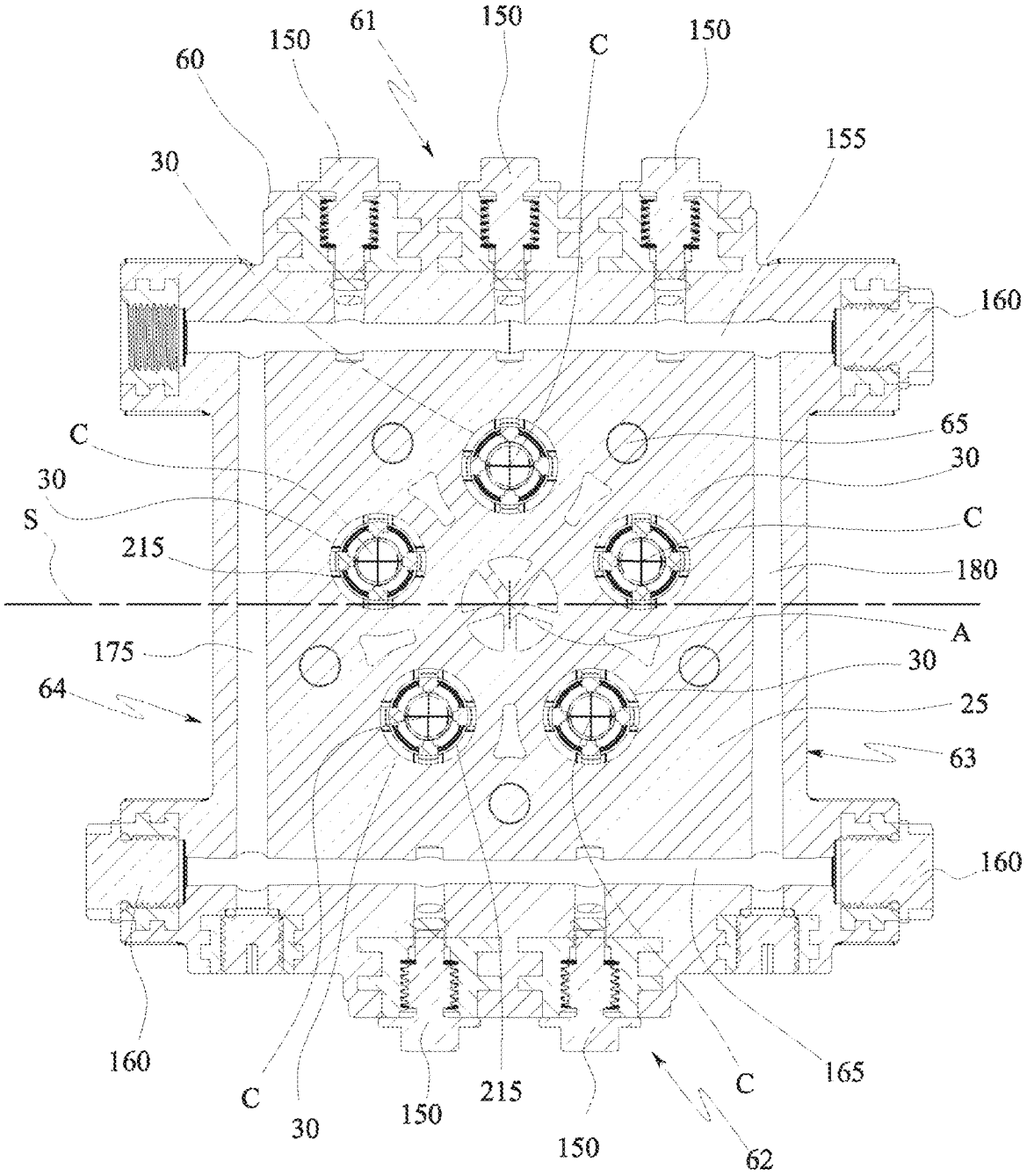
FIG. 3 is a section view according to the plane of FIG. 2.

With particular reference to FIG. 3, the pump 1 may comprise a collection channelling configured to collect the liquid exiting from the delivery valves. In particular, this channelling is in direct fluid connection (therefore in the absence of interposed valves) with a portion of each housing seat 140 of a respective delivery valve, in particular with a portion of this seat downstream of the shutter 125 in relation to the direction of the pumped fluid. This collection channelling is made, for example entirely, in the head and comprises, i.e. is constituted by, a section which follows an annular path in fluid communication with all the delivery valves.

In detail, this section that forms the annular path is radially external to the cylinders 30 in relation to the common axis. In other words, it externally embraces the plurality of cylinders.

In the embodiment shown, said section comprises a first channel 155, for example rectilinear and lying on a plane that is transversal (preferably perpendicular) to the common axis of the cylinders, the first channel being in fluid communication with (all) the housing seats 140 of the delivery valves 120 at the first side 61. Preferably, the first channel intersects (as can be noted in the section of FIG. 6) said housing seats, i.e. the recesses of said seats, in this way it is not necessary to create a special duct to place the housing seat in communication with the first channel. In detail, the first channel is made as a (single) through hole which crosses the head, for example the side surface thereof 60, from side to side intersecting said housing seats, i.e. the recesses of said seats.

The first channel 155 therefore forms two openings in the head, of which at least one is hermetically closed, for example only one, by a plug 160 fixed (screwed) to the head. The opposite opening can have a quick coupling mechanism or a thread for the connection of a delivery pipe external to the pump.

In the embodiment shown, said section also comprises a second channel 165, for example rectilinear and lying on a plane that is transversal (preferably perpendicular) to the common axis of the cylinders, the second channel being in fluid communication with (all) the housing seats 140 of the delivery valves 120 at the second side 62. Preferably, the second channel intersects said housing seats, i.e. the recesses of said seats, in this way it is not necessary to create a special duct to place the housing seat in communication with the second channel. In detail, the second channel is made as a (single) through hole which crosses the head, for example the side surface thereof 60, from side to side intersecting said housing seats 140, i.e. the recesses of said seats.

The first channel 165 therefore forms two openings in the head, of which at least one is hermetically closed by a plug 160 fixed (screwed) to the head. For example, both openings are closed by respective plugs 160.

Still in the embodiment shown, said section also comprises a third channel 175 and a fourth channel 180, for example rectilinear, which are made in the head and connect the first channel 155 to the second channel 165 by diametrically opposite portions of said channels in relation to a plane perpendicular to the imaginary secant plane and containing the common axis of the cylinders. In practice, the second and third channel are transversal to the imaginary secant plane S and cross it.

Like the first and second channel, the third and fourth are also each made as a (single) blind hole made in the head and which forms an opening closed by a suitable plug 160. These blind holes which make the third and fourth channel directly intersect the first and the second channel.

It is not excluded that the third and the fourth channel can be made as a through hole that crosses the head from side to side.

Furthermore, it is not excluded that in an alternative less preferred embodiment, since it is more cumbersome, the third channel and the fourth channel can be replaced by a three-way duct external to the pump, which has a first inlet mouth connected to the first channel, a second inlet mouth connected to the second channel and an outlet mouth. In this case, the second channel must be closed only in one of its two openings in the head to allow the connection of the three-way duct.

The pump 1 comprises a suction valve 185, of the automatic type, for each cylinder 30. Each suction valve 185 is housed in a housing seat 190 made in the head and for example is provided with an outlet mouth 195 in direct fluid communication with an internal volume of the cylinder 30. Preferably, the outlet mouth can be made in a side surface of the cylinder 30.

In the embodiment shown, the housing seats 190 of the suction valves 185 are made inside the cylinders 30, for example near the second face. For example, the outlet mouths of the housing seats have central axes parallel, preferably coaxial, to the central axes of the respective cylinders.

It is not excluded in an alternative embodiment that the suction valves may not be housed in the cylinders 30, but may be positioned in specific seats made in the head and in fluid communication with the cylinders through specific suction ducts.

However, in this case the pumping chamber would necessarily have a larger volume, since it would also include the volume of the suction duct, i.e. the volume of a suction duct extending from the cylinder to the suction valve.

Coming back to the embodiment shown, each suction valve 185 comprises a shutter 200 which is held in contact, via an elastic element, with an abutment surface 205 surrounding a through hole 210, so as to hermetically close said through hole. This through hole is crossed by the fluid suctioned by the piston when the shutter is in a distal position from the abutment surface.

When the pressure inside the cylinder drops below a predetermined value, this pressure of the liquid overcomes the force of the elastic element, moving the shutter and allowing it to cross the through hole. This through hole is for example coaxial to the outlet mouth 195 of the housing seat 190 of the suction valve.

The housing seats 190 of the suction valves 185 are shaped like recesses made in the head and provided with an opening turned towards the outside of the head, through which the valve can be inserted and extracted.

These openings of the seats of the delivery valves, therefore substantially the recesses, are made in the second facade and correspond to the second openings of the cylinders. The pump comprises a perforated spacer 215, which allows a passage of liquid to and from the suction valve and which is interposed between the suction valve and the cover configured in such a way that when the cover is in position, the spacer is pushed against the suction valve and holds it in position.

The pump 1 comprises a suction channelling for the distribution of the liquid to be pumped to the cylinders 30. In particular, the suction channelling is in direct fluid communication with a portion of the cylinders 30 located upstream of the suction valve 185, i.e. a portion of the housing seat 190 located upstream of the suction valve, in relation to the flow direction of the fluid when the pump is in use. In particular, said channelling is in communication with the portion of the cylinder, i.e. of the housing seat 190, at the perforated spacer.

The channelling for suctioning the liquid to be pumped comprises a primary duct 220, which is made in the head and preferably runs along a longitudinal axis.

The primary duct 220 is located between the central axes of the cylinders 30, that is, it is contained in a space between all the central axes of the cylinders 30, i.e. is located in a space of the head between all the cylinders. In even more detail, the primary duct 220 is contained in a space between the central axes of each pair of cylinders 30 of the plurality of cylinders 30 diagonally opposite to the common axis.

For example the primary duct 220 is equidistant from all the central axes of the cylinders 30, that is the longitudinal axis of the primary duct 220 is equidistant from all the central axes of the cylinders 30.

The longitudinal axis of the primary duct 220 is for example parallel to the central axes of the cylinders 30, preferably also coaxial to the common axis of the cylinders 30.

In the embodiment shown, the primary duct 220 is interposed between the cylinders 30, that is it is contained in a space between all the cylinders. Or again, it is located in a position interposed between each pair of cylinders 30 of the plurality of cylinders 30. Furthermore, the primary duct 220 is preferably of a cylindrical shape. However it is not excluded in an alternative embodiment for it to be conical in shape.

For example, the primary duct 220 may substantially be shaped as a blind hole running along its own longitudinal axis from the second face 40 of the head 25 towards the inside of the head 25.

The suction channelling also comprises a plurality of branch ducts 225 one for each cylinder 30, which are made in the head and are configured to place the primary duct 220 in fluid connection with the cylinders 30, in particular with the portion of the cylinders 30 located upstream of the suction valve 185 in relation to the fluid flow direction when the pump is in use.

In the embodiment shown, the branch ducts 225 each have a pair of side walls 230, which are opposing each other, that is facing each other, and each one comprises at least a curved surface with a single axis of curvature, said axis of curvature being transversal to a plane perpendicular to the central axes of the cylinders 30, preferably it is parallel to the central axes of the cylinders 30.

For example, the curved surfaces define respective concave portions turned to each other. Furthermore, the curved surfaces of the side walls of each branch duct 225 are symmetrical to an axis of symmetry containing the central axis of the respective cylinder 30.

The side walls may also comprise more curved surface, each of which has a single axis of curvature as described above.

In the embodiment shown, the pair of curved surfaces extends from the primary duct 220 to the respective cylinder 30, that is the curved surfaces wholly define the respective side walls 230.

Each branch duct 225 may also comprise an additional pair of side walls 235, preferably flat and opposing each other. Each wall of the additional pair of side walls is configured to extend from a side wall 230 to the opposite side wall 230.

For example the side walls 230 of the additional pair of side walls 235 each lie on a transversal plane in relation to the central axes of the cylinders 30, preferably perpendicular to the central axes of the cylinders 30.

The pair of side walls 230 and the additional pair of side walls 235 form the respective branch duct 225.

It is not excluded that in other embodiments the branch ducts may have a circular section transversal to its own longitudinal axis, that is they are shaped like cylindrical ducts or that may be at least partially defined by holes extending from the primary duct 220 to the side surface 60 of the head 25.

The pump 1 may also comprise return ducts 240, which place the cylinders 30 in fluid communication with the primary duct 220 independently from the branch duct 225. Each return duct 240 opens into a portion of the respective cylinder axially comprised between a pair of the annular sealing gaskets 105 and crosses the annular body.

In this way it is possible to directly take the liquid under pressure leaking from the annular gaskets present in the cylinder directly to the suction channelling.

The operation of the pump described above is as follows.

After the movement of the inclined rotating plate, in one or more cylinders at the same time, the movement of the respective piston towards the bottom dead centre generates a vacuum inside the pumping chamber, which in turn causes the respective delivery valve to close and the respective suction valve to open. Consequently, liquid is suctioned from the primary duct 220 and through the corresponding branch duct reaches the corresponding pumping chamber crossing the respective suction valve. Having reached the bottom dead centre, the piston rises towards the top dead centre following the thrust of the rotating plate, generating an overpressure in the pumping chamber which closes the suction valve and opens the delivery valve. The fluid thus flows through the delivery valve into the respective collection duct of the valve where it travels along a part of the annular section and then exits from the opening to which a pipe external to the pump is connected. The invention thus conceived is susceptible to several modifications and variations, all falling within the scope of the inventive concept.

Moreover, all the details can be replaced by other technically equivalent elements.

In practice, the materials used, as well as the contingent shapes and sizes, can be whatever according to the requirements without for this reason departing from the scope of protection of the following claims.

The invention claimed is:

1. An axial piston pump of the rotating inclined plate type for pumping a liquid comprising:

a head, a plurality of cylinders made in the head in a number greater than two, having axes parallel to each other and the cylinders being arranged radially around a common axis parallel to the axes of the cylinders, a plurality of pistons, each slidingly inserted within a respective cylinder of the plurality of cylinders for the pumping of the liquid, a plurality of delivery ducts made in the head, each of which runs directly from a respective cylinder to a respective delivery valve and is arranged transversely to the axis of the respective cylinder, wherein the head has a first side and a second side, the second side being opposite to the first side in relation to an imaginary intersecting plane which contains the common axis and which is parallel to the axes of the cylinders, wherein the plurality of cylinders comprises a first group of cylinders, each cylinder of the first group has its own axis between the first side and the imaginary intersecting plane, and a second group of cylinders, each cylinder of the second group has a central axis between the second side and the imaginary intersecting plane, wherein the delivery ducts running from the cylinders of the first group of cylinders, run from the respective cylinder towards the first side, and the delivery ducts running from the cylinders of the second group of cylinders, run from the respective cylinder towards the second side, and wherein the head and the base of the pump are made is made of a polymeric material, wherein the pump comprises a channelling for suctioning the liquid to be pumped, which comprises a primary duct and a plurality of branch ducts, each of said branch ducts being adapted to place the primary duct in fluid communication with a respective cylinder of the plurality of cylinders, and wherein the primary duct is positioned between the central axes of the plurality of cylinders and has an axis parallel to the cylinder axes, wherein each branch duct comprises a pair of walls, opposing each other, each one provided with respective curved surfaces each one having respectively a single transversal axis of curvature in relation to a plane perpendicular to the central axes of the cylinders.

2. The pump according to claim 1, comprising a collection channelling configured to collect the liquid exiting from the delivery valves, which is made in the head and comprises a portion which follows a closed loop path in fluid communication with all delivery valves.

3. The pump according to claim 1, comprising a suction valve for each cylinder, wherein each suction valve is housed in a housing seat provided with an outlet mouth in direct fluid communication with an internal volume of the cylinder.

4. The pump according to claim 1, wherein the inlet channelling is made in the head.

5. The pump according to claim 4, wherein the primary duct is equidistant from all cylinders.

6. An axial piston pump of the rotating inclined plate type for pumping a liquid comprising:

a head, a plurality of cylinders made in the head in a number greater than two, having axes parallel to each other and the cylinders being arranged radially around a common axis parallel to the axes of the cylinders, a plurality of pistons, each slidingly inserted within a respective cylinder of the plurality of cylinders for the pumping of the liquid, a plurality of delivery ducts made in the head, each of which runs directly from a respective cylinder to a respective delivery valve and is arranged transversely to the axis of the respective cylinder, wherein the head has a first side and a second side, the second side being opposite to the first side in relation to an imaginary intersecting plane which contains the common axis and which is parallel to the axes of the cylinders, wherein the plurality of cylinders comprises a first group of cylinders, each cylinder of the first group has its own axis between the first side and the imaginary intersecting plane, and a second group of cylinders, each cylinder of the second group has its own axis between the second side and the imaginary intersecting plane, wherein the delivery ducts running from the cylinders of the first group of cylinders, run from the respective cylinder towards the first side, and the delivery ducts running from the cylinders of the second group of cylinders, run from the respective cylinder towards the second side, the axial piston pump comprising a collection channelling configured to collect the liquid exiting from the delivery valves, which is made in the head and comprises a portion which follows a closed loop path in fluid communication with all delivery valves, and wherein the collection channelling comprises at least a first and a second through holes which crosses the head from side to side and intersect respectively the housing seats of the delivery valves of the first side and the housing seats of the delivery valves of the second side.

7. Axial piston pump according to claim 6, wherein at least the portion of the head in which the cylinders are disposed is made of a polymeric material.

* * * * *